United States Patent [19]

Beyer et al.

[11] Patent Number: 4,762,105

[45] Date of Patent: Aug. 9, 1988

[54] CONTROL SYSTEM FOR AN EXTRINSIC-IGNITION INTERNAL COMBUSTION ENGINE RESPONSIVE TO AN ENGINE LOAD SIGNAL PROVIDED TO DUAL CONTROL UNITS

[75] Inventors: Hans-Ernst Beyer, Oberriexingen; Jörg Bonitz, Mühlacker; Robert Entenmann, Benningen; Siegmar Förster, Schwieberdingen; Rochus Knäb, Kornwestheim; Walter Künzel, Ludwigsburg; Wolfgang Kugler, Vaihingen/Enz; Alfred Mahlberg, Freiberg; Bernhard Miller; Matthias Philipp, both of Stuttgart; Siegfried Rohde, Schwieberdingen; Stefan Unland, Ludwigsburg; Walter Viess, Schwieberdingen; Herbert Winter, Stuttgart; Jürgen Zimmermann, Schwieberdingen, all of Fed. Rep. of Germany

[73] Assignee: Robert Bosch GmbH, Stuttgart, Fed. Rep. of Germany

[21] Appl. No.: 850,149

[22] Filed: Apr. 10, 1986

[30] Foreign Application Priority Data

Apr. 12, 1985 [DE] Fed. Rep. of Germany ..... 3513086

[51] Int. Cl.[4] ..... F02P 5/15

[52] U.S. Cl. ..... 123/417; 123/494; 364/133; 364/431.04

[58] Field of Search ..... 123/480, 417, 488, 494; 364/131, 133, 431.05, 431.04

[56] References Cited

U.S. PATENT DOCUMENTS 4,250,858 2/1981 Jeeniche et al. ..... 123/417
4,359,987 11/1982 Wesemeyer et al. ..... 123/416 X
4,403,584 9/1983 Suzuki et al. ..... 123/417
4,440,131 4/1984 Felger et al. ..... 123/480 X
4,556,943 12/1985 Pauwels et al. ..... 123/480 X
4,676,215 6/1987 Blocher et al. ..... 123/489

*Primary Examiner*—Tony M. Argenbright
*Attorney, Agent, or Firm*—Frishauf, Holtz, Goodman & Woodward

[57] ABSTRACT

A first control unit of a multiple function control system for a motor vehicle engine controls a function, such as fuel injection, for which it is desirable to provide an engine load signal measured by the amount of air drawn or forced into the engine per unit of time, determined by what is generally known as an air quantity meter. A second control unit of the control system controls the timing of an electrical ignition system for which it has been conventional to supply an engine load signal derived from a pressure transducer. In order to dispense with the pressure transducer and to make both control units subject to adaptive correction of the air quantity signal, the output of the air quantity meter is furnished to the second control system for modification therein by the computation facilities normally included in modern ignition control systems so as to shift or expand the range of engine load signals obtained from the air quantity meter to provide the same degree of resolution as would be available from a pressure transducer. For adaptive correction, the engine-load-to-engine-speed characteristic at a predetermined position of the throttle valve at or near full load is stored, both to provide a plausibility check of the system when the engine is operating at or near full load, and to provide for a correction of the engine load signal of a kind which would minimize the difference between the actual and reference characteristic lines when the engine is operating at or near full load.

77 Claims, 4 Drawing Sheets

PULSE SHAPER
BUS
CPU
50
ROM
51
RAM
52
ADC
U2
INPUT
OUTPUT
FIRST CONTROL UNIT
U1
LM
AIR QUANT. MEAS.
R1
R2
R3
R2'
R3'
UB
n
KW
L
T
18
17
18a
40
41
42
43
45
46
47
48
49
53
54
55
56
57
58
19
20
21
30

CONTROL SYSTEM FOR AN EXTRINSIC-IGNITION INTERNAL COMBUSTION ENGINE RESPONSIVE TO AN ENGINE LOAD SIGNAL PROVIDED TO DUAL CONTROL UNITS

This invention relates to control systems for extrinsic-ignition internal combustion engines, such as gasoline engines of motor vehicles, for controlling the fuel/air mixture supplied the engine and ignition timing by separate control units essentially independent of each other, the former utilizing an engine load sensor which may be an air quantity sensor and the latter incorporating a microcomputer in which are stored at least data for iginition timing as a function of at least engine load and engine speed. Various motor vehicle manufacturers have provided dual control systems of the general type just mentioned in quantity production, for example, the Volvo B200E known in Europe and the Audi 200 Turbo and the VW Rabbit GTI, both of which have been exported to the United States. By the use of two control units, one for affecting the fuel/air mixture and the other for controlling ignition timing, a high degree of flexibility is obtained because both control units can individually be adapted to meet the specifications chosen by the manufacturer.

Since the two control units to a great extent operate independently of each other and can also be installed separately as so-called self-contained components, the result of installing both control units is that two different sensors are installed to provide, to the respective units, the same control unit input information. Thus, for example, it is common for the control unit serving essentially for ignition timing utilizes a pressure sensor installed in the intake manifold of the engine as an load signal sensor. For the second control unit, serving essentially for controlling the fuel/air mixture supplies to the engine, a pressure sensor can, of course, also be used as an engine load sensor, but it has been found advantageous to measure the quantity of air sucked in by the engine for the load information. For this purpose, an air quantity meter of a known type, for example, constituted as a flap in the intake manifold of the engine, is used, or else a hot wire air mass flow meter. Of course, still other ways of measuring engine load are conceivable, for example, measuring the position of the throttle valve, or the like.

SUMMARY OF THE INVENTION

With the development of such dual engine controls, there remained the task of providing only a single engine load sensor for both control units instead of two different load sensors, in order to make possible more economic production of these dual systems. It is an object of the present invention to achieve such an economy with little or no hardware changes in the construction of the control units, so that the two control units could remain self-contained while having the benefit, with regard to economical manufacture, of utilizing components that are to a great extent the same or equivalent, and independent of special requirements.

It is accordingly an object of the present invention to provide apparatus that makes it possible to provide two control units for control or regulation of ignition timing and fuel/air mixture to a great extent independent of each other, taking better account of economic aspects of their manufacture and the possibility of their installation in a vehicle without compromising the accuracy of the systems heretofore known, and with minimizing the modification expense.

Briefly, the object of the invention is attained by providing the engine load information for the ignition timing control from the same sensor that supplies load information to the fuel/air mixture control and by providing an ignition timing control using computation facilities for modifying the output characteristic of the load sensor. Preferably, the load sensor is an intake air quantity measuring sensor, and the values of the output signals of the laod sensor are modified by the provision of an additive or a multiplicative magnitude.

The invention has the advantage not only of making possible substantially more economical manufacture of the control untis, but also minimizing sources of error based on sensor failures.

A particularly advantageous development of the invention is achieved when the engine load information is processed in the ignition timing control unit as a relative value. In this way, the effect of manufacturing variations among load sensors of the same production line are to a great extent moved out.

The modification of the load sensor signal with an additive or multiplicative magnitude can advantageously introduce a depedence on the engine r.p.m. By appropriate fixing of these magnitudes, which can be deposited conveniently in the storage means of a control unit, the value range of the output signals of the laod sensor can be fitted to the operating requirements of the control units, making possible a very high precision of processing with minimum hardware expense.

It has also been found desirable for the output signals to the load sensor to be subjected to a corrective modification related to a comparison of the desired-to-actual value characteristic of the load sensor. In this way, excellent stability of the sensor system relative to time is assured.

BRIEF DESCRIPTION OF THE DRAWINGS

The invention is further described by way of illustrative example with reference to the annexed drawings, in which.

DESCRIPTION OF THE ILLUSTRATED EMBODIMENTS

Figure 1:
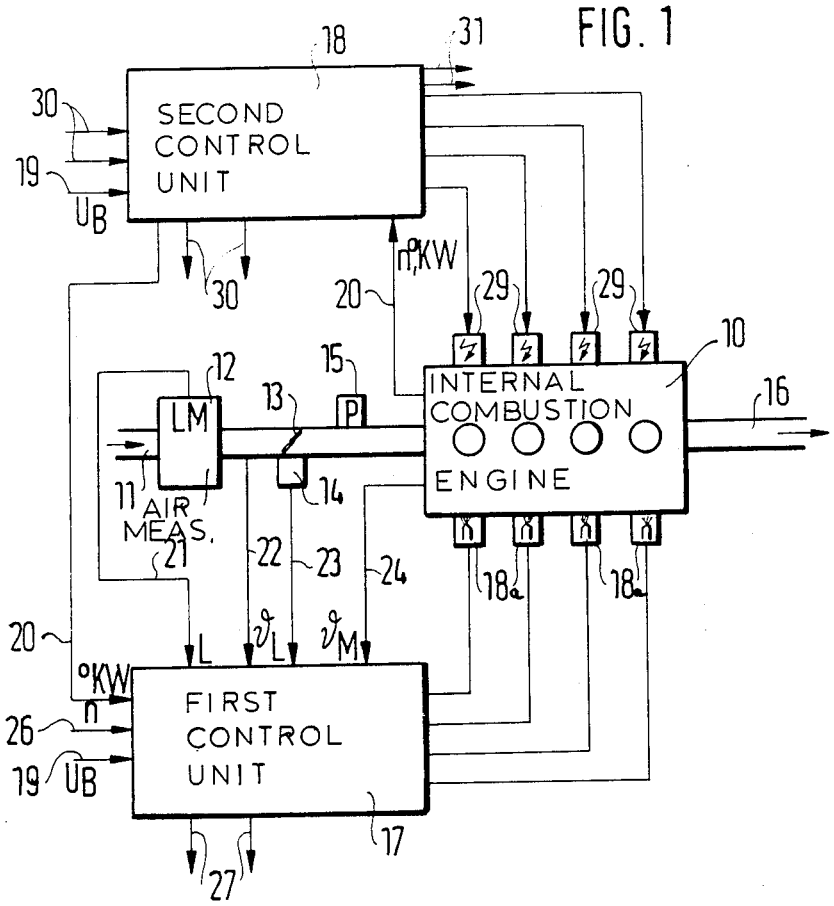
FIG. 1 is a schematic representation of an internal combustion engine with two control units and various signal source transducers.

An internal combustion engine is symbolically designated 10 in FIG. 1. On the intake side of the engine, the air necessary for burning the fuel enters through an intake manifold 11. In the intake 11, is a sensor 12 for detecting or measuring the amount of air sucked into the engine. Downstream from the sensor 12, is a throttle valve 13 with a throttle valve switch 14 and downstream from the thottle valve 13 is a sensor 15 for measuring the pressure that reigns in the intake manifold 11. On the exhaust side of the engine 10, is an exhaust manifold 16 connected to a muffler and exhaust pipe (neither shown) for release of the exhaust gas.

A first control unit 17 serves for controlling the fuel-/air mixture and, in the illustrated example, supplies signals for control of the fuel injection valves 18*a* and thereby determines the amount of fuel injected into the cylinder of the engine. Of course, the invention is not limited to a system for fuel injection into individual cylinders as shown by way of example in FIG. 1. It is also just as applicable, as should be clearly understood from what has already said of the nature of the invention, to engines with intake manifold injection or with continuous individual cylinder injection (in contrast to intermittent individual cylinder injection).

Various input data are supplied to the first control unit 17, namely data 19 regarding battery voltage, data 20 regarding engine speed, data 21 regarding engine load, which in the illustrated example are derived from the sensor 12, data 22 regarding the intake air temperature, data 23 regarding the position of the throttle valve 13, derived from the throttle valve position sensor 14, data 24 regarding motor temperature and still other information 26 not further specified. Along with the output data for the injection intervals for the injection valve 18*a*, there are other outputs 27 that are provided, by which the fuel/air ratio is also to be controlled or modified. For example, by means of these output values, engine speed control or regulation can be carried out by means of a controllable air bypass not shown in the drawing, or by control of exhaust gas recycling. In order to simplify this explanation, so far as can be done without sacrifice of intelligibility, only the control for measuring out the fuel will be described, in what follows, regarding the first control unit.

The second control unit 18 essentially delivers output signals for control of the ignition unit 29 of the engine in a manner dependent upon input information regarding engine speed or degrees of crankshaft position angle 20, battery voltage data 19 and other input data magnitudes 30 not further specified except by mention that they contain data regarding either fuel injection rate or else regarding the supercharging pressure of a supercharger not shown in the drawing, or else the tendency of the engine to knock. Still other output magnitudes can serve for controlling the charging pressure or other operating parameters of the engine or for engine knock prevention.

Figure 1A:
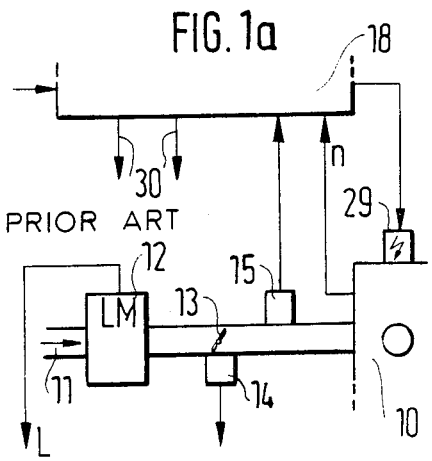
FIG. 1*a* shows the provision of the engine load signal for both control units in accordance with the prior art.

In FIG. 1*a*, the prior art is illustrated, to show from what sensors the two control units obtain their engine load information. Whereas the first control unit 17 obtains its load information from the sensor 12 in terms of the amount of air sucked into the engine, the load information for the second control unit 18 is derived from the pressure sensor 15 that measures the intake suction in the intake manifold 11 of the engine 10.

Figure 1B:
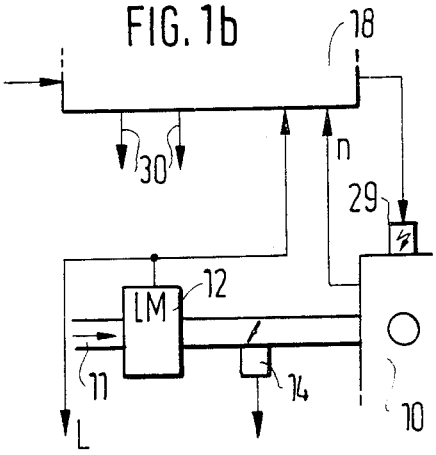
FIG. 1*b* shows the obtaining of the load information for the two control units in accordance with the invention.

FIG. 1*b* shows part of the improvement of the present invention in contrast with the prior art, namely the feature that the engine load information for the second control unit 18 is also derived from the sensor 12 for measuring the air quantity sucked into the engine 10. As symbolically illustrated in FIG. 1*b*, the expense of the pressure sensor 15 is saved in this case, as the result of which there is made possible more economic manufacture and greater reliability of the combination of the two control units. The invention, however, does not consist exclusively in providing a substitution of the load sensor for the second control untit 18, but rather a particularly hardware-economical adaptation of the second control 18 to the changed characteristic of the engine load input information of the sensor 12. For such an adaptation of the sensor 12 output, the following criteria are predominant. First, no extensive changes in the hardware aspect of the construction of the second control unit 18 should be required because of the changed engine load information. Second, the adaptation should rather be performed essentially by software changes. Third, the precision of response of the second control unit 18 to the new load information should, in any event, not show any deterioration in comparison with the performance of the systems of the prior art. Finally, fourth, the quality of operation should to a great extent be independent of random variations of the sensor 12 resulting from tolerances permitted in the manufacturing process.

Figure 2:
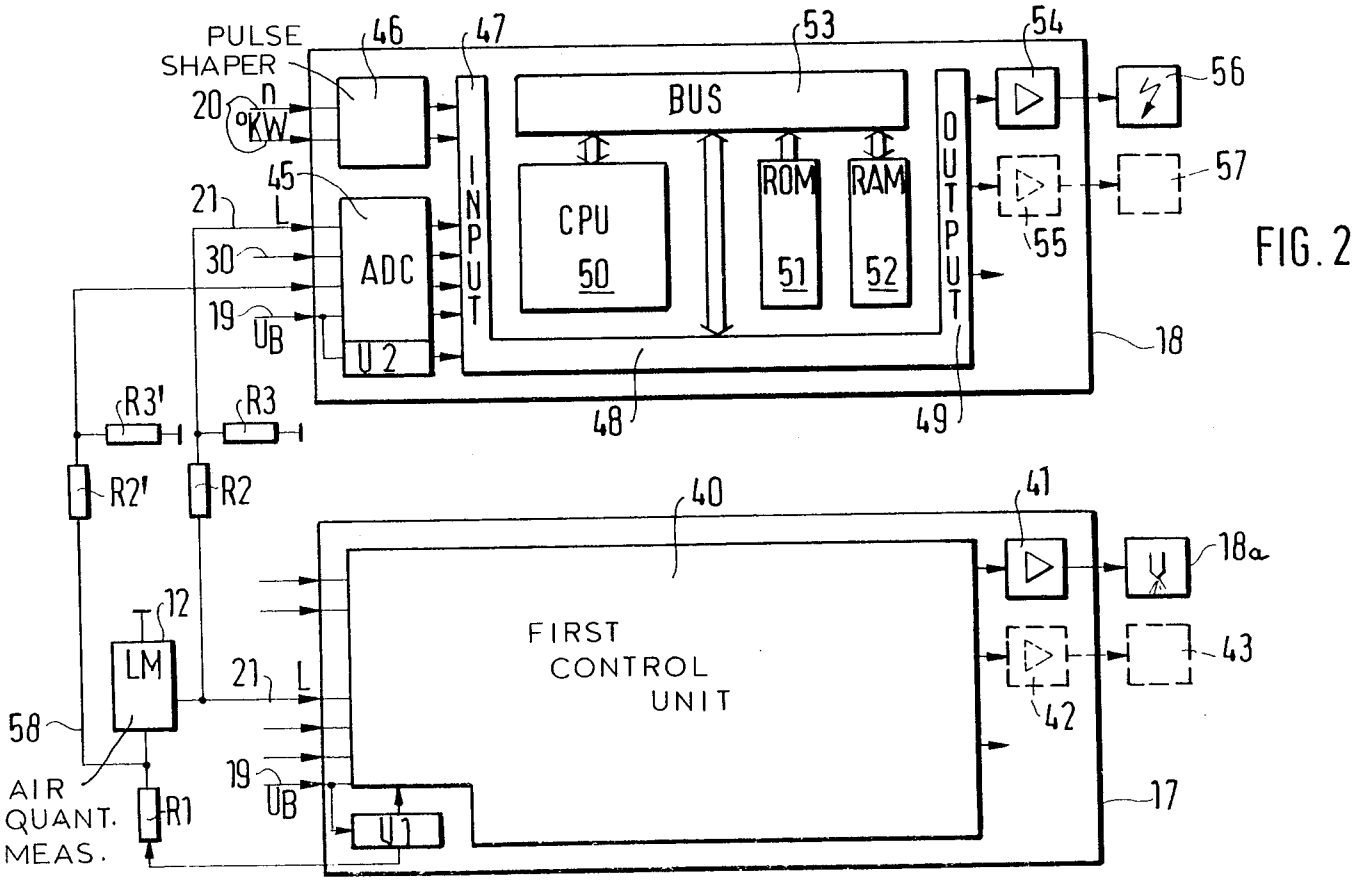
FIG. 2 is a basic circuit block diagram of the two control units with signal adaptation for the output signals of the load sensor.

FIG. 2. shows a basic block diagram of the construction of the two control units 17 and 18. Since the internal details of the first control unit 17 for determining the fuel/air mixture in the present case is not of particular interest here, this control unit is shown as a so-called black box 40. The already-mentioned input data, especially the data 19 regarding battery voltage on the data 21 regarding engine load, are supplied to the block 40 just mentioned. All other input data can be left out of consideration for the following explanation. The circuit block 40 controls, on its output side, the final stages 41 which in turn are connected to the injection valve 18*a*. Additional final stages for actuating other control members 43 are provided.

A load signal is obtained from the sensor 12 for measuring the air quantity sucked in, this load signal being made available at the center terminal of a potentiometer mechanically coupled to the movable part of the air quantity meter. This potentiometer of the sensor 12 is in series with a protective resitor R1, which in turn is connected to a reference voltage source U1 which is supplied with the battery voltage UB. The voltage at the middle tap of the potentiometer of the sensor 12 is thus a measure for the deviation for displacement of the movable part of the air quantity meter and thus contains data regarding the engine load. Provision of sensors for measuring the quantity of air sucked in by the engine can be fulfilled according to various measuring principles, for example, on the heated wire principle or the vortex principle, with their outputs being further processed as equivalent engine load information.

The construction of the second control unit 18 is shown in somewhat greater detail in FIG. 2. The input magnitude signals 19 and 21 and other input magnitude signals 30 which, for example, may serve for engine knock control, are converted into digital signals in an analog-to-digital converter 45. The data 20 regarding engine speed and crankshaft rotational angle, which are commonly already present in digital form on the basis of the transducer characteristics, are supplied to a pulse shaper 46, which basically normalizes the pulse shape of the input pulses. All signals available in digital form are supplied to an input unit 47 which is connected to an input/output unit 48 having an output unit 49. The units 47, 48 and 49 constitute the peripheral equipment of a digital signal processing unit which is composed of a central processing unit 50, read-only memory (ROM) 51, operating data storage (RAM) 52 and a bus 53, which all are connected together for transmisison and reception of data. All programs, characteristic data, characteristic line reference values and the like, are stored and protected against loss in the ROM 51, whereas the RAM 52 is write/read storage into which data is stored which is delivered by the sensors until they are called out of storage by the microprocessor or replaced by more recent data. The arithmetic and logical operations for processing the stored data are carried out in the central processing unit (CPU) 50. The output unit 49 in turn controls various final stages 54, 55 which serve to control ignition produced by the unit 56 and to control mechanical control members 57, for example, for control of supercharging pressure.

The output signal of the sensor 12, which serves for measuring the air quantity sucked into the engine, is supplied to the second control unit as engine load information. The second control unit 18 has a reference voltage source U2 independent of the reference voltage source U1 of the first control unit 17, but on account of the tolerance range in the output voltages of these reference voltage sources, care must be taken that the input signal for the second control unit 17 in no case takes on values which lie above the value of the reference voltage source U2 at the particular time. For this reason, there is provided a voltage divider circuit consisting of the resistances R2 and R3 which subdivides the output voltage of the engine load sensor by a certain factor.

In order that the load signal may be provided independently of the absolute value of the potentiometer provided in the sensor 12, a second signal path 58 is provided which leads the voltage appearing across the total resistance of the potentiometer of the sensor 12 over to the second control unit 18. In order that this voltage value also should not get above the reference voltage value U2, another voltage divider circuit consisting of the resistances R2' and R3' is provided.

The two signals respectively at 21 and 58, are essentially divided one by the other in the control unit 18 so that a measurement magnitude may be made available as the engine load signal which is independent of the absolute value of the total resistance of the potentiometer of the sensor 12.

The two control units now compute output magnitudes for controlling the control members or inputs which they serve in a manner dependent upon the various different input information. More particularly, characteristic data fields are provided in the second control unit 18 that are now of interest, in which, for example, the ignition timing magnitude in degrees of crankshaft angle is deposited in the ROM 51 as a function of engine load and engine speed for calling into the working storage 52 by an address corresponding to the engine load and engine speed.

Figure 3A:
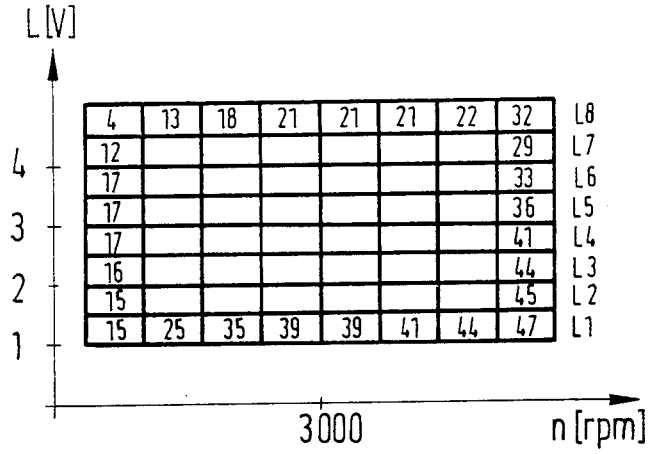
FIG. 3*a* shows an engine speed characteristic field for ignition timing when the load signal, in accordance with the prior art, is derived from a pressure sensor.

An example for such a characteristic field is shown in FIG. 3*a*, in which the field values are expressed as a function of the engine speeed and of the output signals of a pressure sensor serving as an engine load sensor. In a manner dependent upon the output signal of the pressure sensor, there can be distinguished, in the present case, eight engine load ranges L1 to L8 and eight engine speed ranges, so that altogether 64 characteristic field values are stored. Of course, it is possible to interpolate between individual characteristic field values in order to provide finer steps.

Figure 3B:
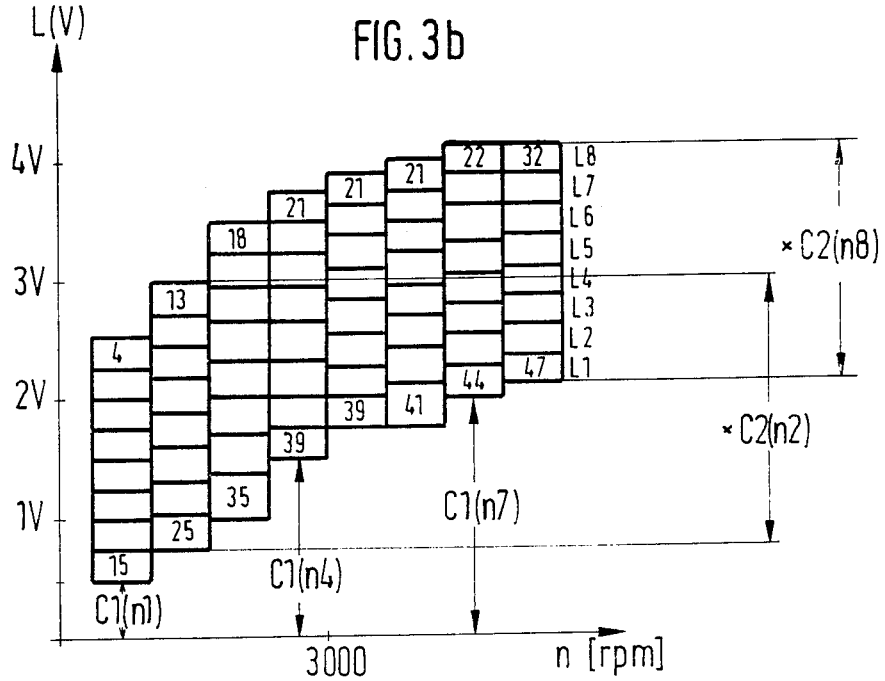
FIG. 3*b* is a diagram of a characteristic field equivalent to FIG. 3*a* for the case in which the engine load information is obtained from an air quantity meter.

If now the engine load signals for identifying the various characteristic field values for various engine speeds are provided by an air quantity sensor instead of by a pressure sensor, in particular, when they are derived form an air-impelled flap sensor, the characteristic field then takes the form illustrated in FIG. 3*b* as the result of the completely different output characteristic of the air quantity sensor. In particular, FIG. 3*b* makes plain that a load region, for example, the load range L1, can no longer be described by a fixed output voltage value over the entire engine speed range, and, instead, the voltage values for each load region or range cover a wide speed-dependent range. In addition, it is made plain that the output signal characteristic of the air quantity meter is so constituted that the output values of the air quantity meter are far from occupying the complete maximum possible range of the possible output values. It, therefore, follows that for obtaining the same resolution a substantially larger storage capacity is necessary for storing the characteristic field values.

Since the storage capacity of a contemporary system is still scarce and hardware changes such as incorporating additional storage components in the control unit are to be avoided, the output signals of the sensor 12 as they appear in the second control unit, are modified by computing functions so that the output characteristic of the sensor 12 may be varied. It is therefore finally obtained that the output signal value range of the air quantity sensor is compressed in a manner dependent upon engine speed and shifted so that an optimal use of the available storage space for engine load measurement is obtained with resolution remaining equal to that obtainable with the use of a pressure sensor. The process for modifying the output signal characteristic of the air quantity meter will now be explained with reference to FIG. 3*b*.

The possible ranges of output values of the air quantity signal in the individual engine speed ranges is modified by additive magnitudes C1 (n1), . . . , C1 (n8), . . . in such a way that the lowest values of all value ranges take on the same common value. This value can, for example, correspond to the zero line (axis) in the illustrated coordinate system, or some other preferably evident base value. In a second step, the individual possible values of every speed dependent value range and modified by a corresponding multiplicative magnitude C2 (n1), . . . , C2 (n8), . . . , these multiplicative values, like the additive values C1, being individually selected for the various speed ranges. The multiplicative modification is for the purpose of fitting the size of the speed-dependent value ranges to each other. In a simplified version, the multiplicative constant C2 could be the same for all speed ranges, especially if the variation of the individual speed-dependent value ranges of the output signals of the air quantity sensor would come out essenitally the same or with negligible differences from each other.

By these additive and/or multiplicative changes of the output signals of the air quantity sensor, the result is obtained that the value range in each of the individual speed ranges is essentially the same in each case.

After experimental determination of the magnitudes C1 (n) and C2 (n) and storing them in the ROM 51, it is possible to have an arrangement of the characterisstic field values, such as is shown in FIG. 3*a* for the case of obtaining of engine load signals from a pressure sensor. Even the precision, i.e., the extent of quantizing, is maintained, so by the above-described software-basis transformation of the output signals of the air quantity sensor, it is possible to provide a characteristic field value array that is identical to that which is producible when a pressure sensor is used for the engine load information. Furthermore, it is possible to fit these magnitudes C1 (n) and C2 (n) to changes with time by means of adaptive regulation strategies. Such adaptive regulation strategies are illustrated, for example in patent application No. P 34 08 215.8 in the Federal Republic of Germany, corresponding to U.S. Pat. No. 4,676,215, the contents of which are hereby incorporated by reference as a part hereof.

Figure 4:
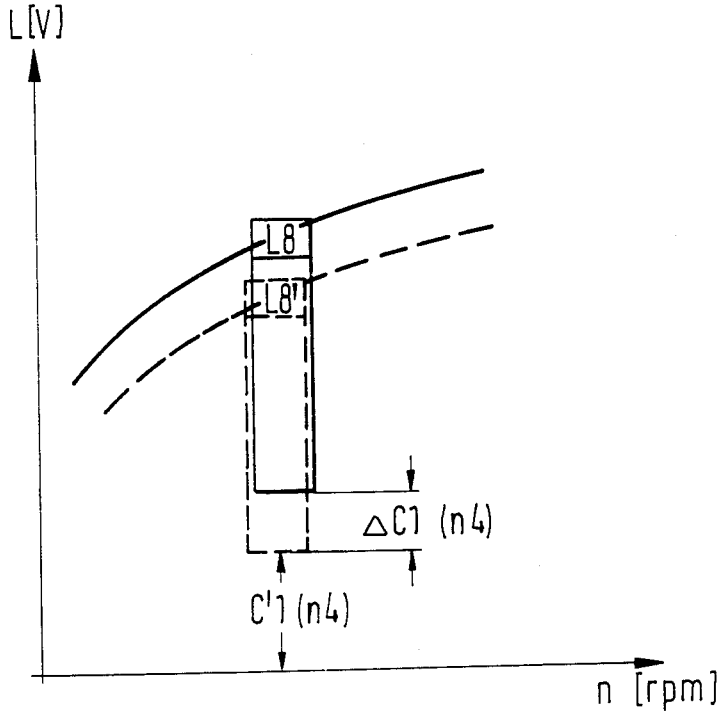
FIG. 4 is a diagram relating to the small area of FIG. 3*b* for explaining the corrective modification of the output signals of the load sensor.

A further advantageous embodiment of the invention is further described with reference to FIG. 4.

The possibility that the setting of the potentiometer with reference to the position of the flap of the air quantity meter in the intake suction channel might vary is an example of one of the possible sources of error in the output values of the air quantity meter. A misadjustment resulting from such an error, would lead to a false correlation of characteristic field values with engine load. Other long-term effects could also falsify the output signal of the sensor. In order to eliminate such effects, a plausibility check of the air quantity measuring sensor signal is carried out in accordance with the invention, by comparing the values stored in the ROM 51 or called out into the RAM 52 with the actual current values of the air quantity sensor output, the comparison taking into account the engine speed at the time. If the result of that plausibility check comparison shows a deviation which is deemed permissible, from one of the stored values, it is then possible to make the addition of a corrective term ΔC1 to the additive modification magnitiudes C1 (n) to produce agreement between the actual and stored values. The full load characteristic curve is particularly suitable for storing as the reference value characteristic line, a throttle vane position sensor 14 being used to monitor the position of the throttle valve flap 13 for detecting the condition of full load. If the throttle is fully open, the full load situation is present and the described comparison of actual and stored values can be carried out. The resulting correction can, in a first approximation, be valid for the entire engine speed range, i.e., all additive magnitudes C1 (n) are modified by one and the same correction term ΔC1. In a closer approximation, it is, furthermore, possible and very advantageous to determine the correction term ΔC1 in a manmner dependent engine speed, so that for every engine speed range, an individual correction term ΔC1 (n) is valid.

Furthermore, it has been found advantageous in various cases of application to introduce a multiplicative correction term ΔC2 that in an analogous way modifies ΔC2 (n) either across the board or in a manner dependent on the speed range.

By means of the above-described adaptive corrections of the currently actual full load characteristic line of the air quantity meter with reference to a reference full load characteristic line stored in a microcomputer memory, it is possible, in spite of tolerances in the measuring system of the air quantity meter manufactured in mass production, to provide the correct full load or upper load range values of a characteristic field. The determination of the correction terms ΔC1 (n) and ΔC2 (n) is performed in such a way that the difference between reference values and current actual values of the engine load characteristic line is eliminated. Viewed as a whole, the invention makes it possible to use an air quantity meter instead of a supplementary pressure sensor for engine load measurement without making any sacrifice in precision or long term stability of the measurement. The invention is not limited only to characteristic field magnitudes such as, for example, the ignition angle referred to in the illustrative examples, it is applicable to characteristic field values for all possible kinds of operating parameters for an internal combustion engine, as for example for exhaust gas control magnitudes, engine knock control magnitudes, supercharger control magnitudes, fuel measuring magnitudes, and the like, which can be stored in fixed values storage devices (ROMs).

It will therefore be seen that although the invention has been described with reference to particular illustrative examples, variations and modifications are possible within the inventive concept.

We claim:

1. Multipurpose control system for an internal combustion engine including a first control unit for a control funtion other than ignition timing and a second control unit for extrinsic ignition timing control, both said first and second control units requiring an input signal representative of engine load and an input signal representative of engine rotary speed, among signals representative of respective aspects of engine operation that may be utilized in a said control unit, said first control unit requiring said signal representive of engine load to be provided to said first control unit in the form of a measure of air quantity sucked into conbustion chambers of said engine, said control system comprising, in addition to said first and second control units:

means (**29, 15*b*) responsive to said second control unit (18) for producing timed ignition in said engine (10**) under timing control by said first control unit;

means (**18*a*) responsive to said first control unit (17) for controlling a variable engine-operation parameter of said engine (10**) other than ignition timing, under control of said second control unit;

means (12) for measuring air quantity sucked into combustion chambers of said engine for providing an engine load output signal (2) to at least said first control unit (17);

means in said second control unit for modifying said output signal of said air quantity measuring means, said second control unit comprising a microcomputer (45–53) having a central processing unit (50) and permanent (51) and temporary ([S]52) data storage means and also including said signal modifying means in the form of program controlled computation capability utilizing stored program and data for modification of said output signal of said air quantity measuring means, said output of said air quantity measuring means being connected to an input of said second control unit for modification thereof by said modifying means before use in further processing by said second control unit for ignition timing control.

2. Control system according to claim 1, in which said signal modifying means in said second control unit are constituted for adding the value of a stored additive magnitude (C1) to the value of said output signal.

3. Control system according to claim 1, in which said signal modifying means in said second control unit are constituted for multiplying the value of said output signal by the value of a multiplying factor magnitude (C2).

4. Control system according to claim 2, in which said signal modifying means and said second control are constituted for multiplying the sum of the values of said output signal of said air quantity measuring means and said additive stored magnitude value (C1) by the value of a stored multiplying factor (C2).

5. Control system according to claim 3, in which said signal modifying means in said second control unit are constituted for adding the value of a stored additive magnitude (C1) to the product of the value of said output signal of said air quantity measuring means and said stored value of a multiplying factor (C2).

6. Control system according to claim 2, in which said value of said stored additive magnitude (C1) is a value dependent at least stepwise on the rotary speed of said engine.

7. Control system according to claim 3, in which said value of said stored multiplying factor (C2) is a value dependent at least stepwise on the rotary speed of said engine.

8. Control system according to claim 4, in which said value of said stored additive magnitude and said value of said multiplying factor are both values dependent upon the rotary speed of said engine.

9. Control system according to claim 5, in which said value of said stored additive magnitude and said value of said multiplying factor are both values dependent upon the rotary speed of said engine.

10. Control system according to claim 6, in which said speed dependent values of said additive magnitude (C1) are values for modifying the value of said output signal of said air quantity measuring means such as to minimize the variation of the range of modified output signals of said air quantity measuring means with respect to engine speed.

11. Control system according to claim 7, in which the speed dependent values of said stored multiplying factor (C2) are values for modifying the value of said output signal of said air quantity measuring means such as to minimize the variation of the range of modified output signals of said air quantity measuring means with respect to engine speed.

12. Control system according to claim 8, in which the speed dependent values of said stored additive magnitude (C1) and also the speed dependent values of said stored multiplying factor (C2) are values for modifying the value of said output signal of said air quantity measuring means such as to minimize the variation of the range of modified output signals of said air quantity measuring means with respect to engine speed.

13. Control system according to claim 9, in which the speed dependent values of said stored additive magnitude (C1) and also the speed dependent values of said stored multiplying factor (C2) are values for modifying the value of said output signal of said air quantity measuring means such as to minimize the variation of the range of modified output signals of said air quantity measuring means with respect to engine speed.

14. Control system according to claim 6, in which said means in said second control unit for modifying said output signal of said air quantity measuring means is constituted to convert said output signal of said air quantity measuring means into a relative rather than an absolute value for minimizing the effect of errors arising from manufacturing tolerances permitted in the manufacture of said air quantity measuring means.

15. Control system according to claim 7, in which said means in said second control unit for modifying said output signal of said air quantity measuring means is constituted to convert said output signal of said air quantity measuring means into a relative rather than an absolute value for minimizing the effect of errors arising from manufacturing tolerances permitted in the manufacture of said air quantity measuring means.

16. Control system according to claim 8, in which said means in said second control unit for modifying said output signal of said air quantity measuring means is constituted to convert said output signal of said air quantity measuring means into a relative rather than an absolute value for minimizing the effect of errors arising from manufacturing tolerances permitted in the manufacture of said air quantity measuring means.

17. Control system according to claim 9, in which said means in said second control unit for modifying said output signal of said air quantity measuring means is constituted to convert said output signal of said air quantity measuring means into a relative rather than an absolute value for minimizing the effect of errors arising from manufacturing tolerances permitted in the manufacture of said air quantity measuring means.

18. Control system according to claim 10, in which said means in said second control unit for modifying said output signal of said air quantity measuring means is constituted to convert said output signal of said air quantity measuring means into a relative rather than an absolute value for minimizing the effect of errors arising from manufacturing tolerances permitted in the manufacture of said air quantity measuring means.

19. Control system according to claim 11, in which said means in said second control unit for modifying said output signal of said air quantity measuring means is constituted to convert said output signal of said air quantity measuring means into a relative rather than an absolute value for minimizing the effect of errors arising from manufacturing tolerances permitted in the manufacture of said air quantity measuring means.

20. Control system according to claim 12, in which said means in said second control unit for modifying said output signal of said air quantity measuring means is constituted to convert said output signal of said air quantity measuring means into a relative rather than an absolute value for minimizing the effect of errors arising from manufacturing tolerances permitted in the manufacture of said air quantity measuring means.

21. Control system according to claim 13, in which said means in said second control unit for modifying said output signal of said air quantity measuring means is constituted to convert said output signal of said air quantity measuring means into a relative rather than an absolute value for minimizing the effect of errors arising from manufacturing tolerances permitted in the manufacture of said air quantity measuring means.

22. Control system according to claim 14, in which a potentiometer is connected across the output of said air quantity measuring means (12), said potentiometer having an adjustable tap for providing said output of said air quantity measuring means at an appropriate level to said first and second control units, and in which means are provided for also supplying to said second control means (18) the output of said air quantity measuring means applied across the total resistance of said potentiometer for calculation of the ratio of the voltage appearing at said tap to the voltage developed across said total resistance of said potentiometer.

23. Control system according to claim 15, in which a potentiometer is connected across the output of said air quantity measuring means (12), said potentiometer having an adjustable tap for providing said output of said air quantity measuring means at an appropriate level to said first and second control units, and in which means are provided for also supplying to said second control means (18) the output of said air quantity measuring means applied across the total resistance of said potentiometer for calculation of the ratio of the voltage appearing at said tap to the voltage developed across said total resistance of said potentiometer.

24. Control system according to claim 16, in which a potentiometer is connected across the output of said air quantity measuring means (12), said potentiometer having an adjustable tap for providing said output of said air quantity measuring means at an appropriate level to said first and second control units, and in which means are provided for also supplying to said second control means (18) the output of said air quantity measuring means applied across the total resistance of said potentiometer for calculation of the ratio of the voltage appearing at said tap to the voltage developed across said total resistance of said potentiometer.

25. Control system according to claim 17, in which a potentiometer is connected across the output of said air quantity measuring means (12), said potentiometer having an adjustable tap for providing said output of said air quantity measuring means at an appropriate level to said first and second control units, and in which means are provided for also supplying to said second control means (18) the output of said air quantity measuring means applied across the total resistance of said potentiometer for calculation of the ratio of the voltage appearing at said tap to the voltage developed across said total resistance of said potentiometer.

26. Control system according to claim 18, in which a potentiometer is connected across the output of said air quantity measuring means (12), said potentiometer having an adjustable tap for providing said output of said air quantity measuring means at an appropriate level to said first and second control units, and in which means are provided for also supplying to said second control means (18) the output of said air quantity measuring means applied across the total resistance of said potentiometer for calculation of the ratio of the voltage appearing at said tap to the voltage developed across said total resistance of said potentiometer.

27. Control system according to claim 19, in which a potentiometer is connected across the output of said air quantity measuring means (12), said potentiometer having an adjustable tap for providing said output of said air quantity measuring means at an appropriate level to said first and second control units, and in which means are provided for also supplying to said second control means (18) the output of said air quantity measuring means applied across the total resistance of said potentiometer for calculation of the ratio of the voltage appearing at said tap to the voltage developed across said total resistance of said potentiometer.

28. Control system according to claim 20, in which a potentiometer is connected across the output of said air quantity measuring means (12), said potentiometer having an adjustable tap for providing said output of said air quantity measuring means at an appropriate level to said first and second control units, and in which means are provided for also supplying to said second control means (18) the output of said air quantity measuring means applied across the total resistance of said potentiometer for calculation of the ratio of the voltage appearing at said tap to the voltage developed across said total resistance of said potentiometer.

29. Control system according to claim 21, in which a potentiometer is connected across the output of said air quantity measuring means (12), said potentiometer having an adjustable tap for providing said output of said air quantity measuring means at an appropriate level to said first and second control units, and in which means are provided for also supplying to said second control means (18) the output of said air quantity measuring means applied across the total resistance of said potentiometer for calculation of the ratio of the voltage appearing at said tap to the voltage developed across said total resistance of said potentiometer.

30. Control system according to claim 6, in which said engine is provided with a throttle valve equipped for foot control and means for providing a signal representative of a predetermined position of said throttle valve (13) and in which said control unit includes means for storing reference values corresponding to the engine-load-to-engine-speed characteristic in operation of said engine with said throttle valve in said predetermined position thereof, and also means for comparing the actual values of engine load and engine speed when said throttle valve is in said predetermined position with said reference values for obtaining a correction value ($\Delta C$) for correction of the transducer characteristic of said air quantity measuring means, and means for applying said correction value for further modification of the output signal of said air quantity measuring means.

31. Control system according to claim 7, in which said engine is provided with a throttle valve equipped for foot control and means for providing a signal representative of a predetermined position of said throttle valve (13) and in which said second control unit includes means for storing reference values corresponding to the engine-load-to-engine-speed chracteristic in operation of said engine with said throttle valve in said predetermined position thereof, and also means for comparing the actual values of engine load and engine speed when said throttle valve is in said predetermined position with said reference values for obtaining a correction value ($\Delta C$) for correction of the transducer characteristic of said air quantity measuring means, and means for applying said correction value for further modification of the output signal of said air quantity measuring means.

32. Control system according to claim 8, in which said engine is provided with a throttle valve equipped for foot control and means for providing a signal representative of a predetermined position of said throttle valve (13) and in which said second control unit includes means for storing reference values corresponding to the engine-load-to-engine-speed characteristic in operation of said engine with said throttle valve in said predetermined position thereof, and also means for comparing the actual values of engine load and engine speed when said throttle valve is in said predetermined position with said reference values for obtaining a correction value ($\Delta C$) for correction of the transducer characteristic of said air quantity measuring means, and means for applying said correction value for further modification of the output signal of said air quantity measuring means.

33. Control system according to claim 9, in which said engine is provided with a throttle valve equipped for foot control and means for providing a signal representative of a predetermined position of said throttle valve (13) and in which said second control unit includes means for storing reference values corresponding to the engine-load-to-engine-speed characteristic in operation of said engine with said throttle valve in said predetermined position thereof, and also means for comparing the actual values of engine load and engine speed when said throttle valve is in said predetermined position with said reference values for obtaining a correction value (ΔC) for correction of the transducer characteristic of said air quantity measuring means, and means for applying said correction value for further modification of the output signal of said air quantity measuring means.

34. Control system according to claim 10, in which said engine is provided with a throttle valve equipped for foot control and means for providing a signal representative of a predetermined position of said throttle valve (13) and in which said second control unit includes means for storing reference values corresponding to the engine-load-to engine-speed characteristic in operation of said engine with said throttle valve in said predetermined position thereof, and also means for comparing the actual values of engine load and engine speed when said throttle valve is in said predetermined position with said reference values for obtaining a correction value (ΔC) for correction of the transducer characteristic of said air quantity measuring means, and means for applying said correction value for further modification of the output signal of said air quantity measuring means.

35. Control system according to claim 11, in which said engine is provided with a throttle valve equipped for foot control and means for providing a signal representative of a predetermined position of said throttle valve (13) and in which said second control unit includes means for storing reference values corresponding to the engine-load-to-engine-speed characteristic in operation of said engine with said throttle valve in said predetermined position thereof, and also means for comparing the actual values of engine load and engine speed when said throttle valve is in said predetermined position with said reference values for obtaining a correction value (ΔC) for correction of the transducer characteristic of said air quantity measuring means, and means for applying said correction value for further modification of the output signal of said air quantity measuring means.

36. Control system according to claim 12, in which said engine is provided with a throttle valve equipped for foot control and means for providing a signal representative of a predetermined position of said throttle valve (13) and in which said second control unit includes means for storing reference values corresponding to the engine-load-to-engine-speed characteristic in operation of said engine with said throttle valve in said predetermined position thereof, and also means for comparing the actual values of engine load and engine speed when said throttle valve is in said predetermined position with said reference values for obtaining a correction value (ΔC) for correction of the transducer characteristic of said air quantity measuring means, and means for applying said correction value for further modification of the output signal of said air quantity measuring means.

37. Control system according to claim 13, in which said engine is provided with a throttle valve equipped for foot control and means for providing a signal representative of a predetermined position of said throttle valve (13) and in which said second control unit includes means for storing reference values corresponding to the engine-load-to-engine-speed characteristic in operation of said engine with said throttle valve in said predetermined position thereof, and also means for comparing the actual values of engine load and engine speed when said throttle valve is in said predetermined position with said reference values for obtaining a correction value (ΔC) for correction of the transducer characteristic of said air quantity measuring means, and means for applying said correction value for further modification of the output signal of said air quantity measuring means.

38. Control system according to claim 30, in which said correction value is an additive correction value (ΔC1) for addition to said output of said air quantity measuring means.

39. Control system according to claim 31, in which said correction value is an additive correction value (ΔC1) for addition to said output of said air quantity measuring means.

40. Control system according to claim 32, in which said correction value is an additive correction value (ΔC1) for addition to said output of said air quantity measuring means.

41. Control system according to claim 33, in which said correction value is an additive correction value (ΔC1) for addition to said output of said air quantity measuring means.

42. Control system according to claim 34, in wtich said correction value is an additive correction value (ΔC1) for addition to said output of said air quantity measuring means.

43. Control system according to claim 35, in which said correction value is an additive correction value (ΔC1) for addition to said output of said air quantity measuring means.

44. Control system according to claim 36, in which said correction value is an additive correction value (ΔC1) for addition to said output of said air quantity measuring means.

45. Control system according to claim 37, in which said correction value is an additive correction value (ΔC1) for addition to said output of said air quantity measuring means.

46. Control system according to claim 30, in which said correction value is a multiplying factor (ΔC2) for multiplying the output signal of said air quantity measuring means and thereby correcting it.

47. Control system according to claim 31, in which said correction value is a multiplying factor (ΔC2) for multiplying the output signal of said air quantity measuring means and thereby correcting it.

48. Control system according to claim 32, in which said correction value is a multiplying factor (ΔC2) fcr multiplying the output signal of said air quantity measuring means and thereby correcting it.

49. Control system according to claim 33, in which said correction value is a multiplying factor (ΔC2) for multiplying the output signal of said air quantity measuring means and thereby correcting it.

50. Control system according to claim 34, in which said correction value is a multiplying factor (ΔC2) for multiplying the output signal of said air quantity measuring means and thereby correcting it.

51. Control system according to claim 35, in which said correction value is a multiplying factor (ΔC2) for multiplying the output signal of said air quantity measuring means and thereby correcting it.

52. Control system according to claim 36, in which said correction value is a multiplying factor (ΔC2) for multiplying the output signal of said air quantity measuring means and thereby correcting it.

53. Control system according to claim 37, in which said correction value is a multiplying factor (ΔC2) for multiplying the output signal of said air quantity measuring means and thereby correcting it.

54. Control system according to claim 38, in which said additive correction value (ΔC1) is dependent at least stepwise on engine speed.

55. Control system according to claim 39, in which said additive correction value (ΔC1) is dependent at least stepwise on engine speed.

56. Control system according to claim 40, in which said additive correction value (ΔC1) is dependent at least stepwise on engine speed.

57. Control system according to claim 41, in which said additive correction value (ΔC1) is dependent at least stepwise on engine speed.

58. Control system according to claim 42, in which said additive correction value (ΔC1) is dependent at least stepwise on engine speed.

59. Control system according to claim 43, in which said additive correction value (ΔC1) is dependent at least stepwise on engine speed.

60. Control system according to claim 44, in which said additive correction value (ΔC1) is dependent at least stepwise on engine speed.

61. Control system according to claim 45, in which said additive correction value (ΔC1) is dependent at least stepwise on engine speed.

62. Control system according to claim 46, in which said multiplying factor (ΔC2) is dependent at least stepwise on engine speed.

63. Control system according to claim 47, in which said multiplying factor (ΔC2) is dependent at least stepwise on engine speed.

64. Control system according to claim 48, in which said multiplying factor (ΔC2) is dependent at least stepwise on engine speed.

65. Control system according to claim 49, in which said multiplying factor (ΔC2) is dependent at least stepwise on engine speed.

66. Control system according to claim 50, in which said multiplying factor (ΔC2) is dependent at least stepwise on engine speed.

67. Control system according to claim 51, in which said multiplying factor (ΔC2) is dependent at least stepwise on engine speed.

68. Control system according to claim 52, in which said multiplying factor (ΔC2) is dependent at least stepwise on engine speed.

69. Control system according to claim 53, in which said multiplying factor (ΔC2) is dependent at least stepwise on engine speed.

70. Control system according to claim 30, in which said predetermined position of said throttle valve is a position in the high engine load region of the throttle valve position range and in which said means for applying said correction value for further modification of the output signal of said air quantity measuring means is constituted for applying said correction value so as to minimize the difference between the said output signal of said air quantity measuring means as modified by said correction value and the most nearly corresponding one of said stored reference values.

71. Control system according to claim 31, in which said predetermined position of said throttle valve is a position in the high engine load region of the throttle valve position range and in which said means for applying said correction value for further modification of the output signal of said air quantity measuring means is constituted for applying said correction value so as to minimize the difference between the said output signal of said air quantity measuring means as modified by said correction value and the most nearly corresponding one of said stored reference values.

72. Control system according to claim 32, in which said predetermined position of said throttle valve is a position in the high engine load region of the throttle valve position range and in which said means for applying said correction value for further modification of the output signal of said air quantity measuring means is constituted for applying said correction value so as to minimize the difference between the said output signal of said air quantity measuring means as modified by said correction value and the most nearly corresponding one of said stored reference values.

73. Control system according to claim 33, in which said predetermined position of said throttle valve is a position in the high engine load region of the throttle valve position range and in which said means for applying said correction value for further modification of the output signal of said air quantity measuring means is constituted for applying said correction value so as to minimize the difference between the said output signal of said air quantity measuring means as modified by said correction value and the most nearly corresponding one of said stored reference values.

74. Control system according to claim 34, in which said predetermined position of said throttle valve is a position in the high engine load region of the throttle valve position range and in which said means for applying said correction value for further modification of the output signal of said air quantity measuring means is constituted for applying said correction value so as to minimize the difference between the said output signal of said air quantity measuring means as modified by said correction value and the most nearly corresponding one of said stored reference values.

75. Control system according to claim 35, in which said predetermined position of said throttle valve is a position in the high engine load region of the throttle valve position range and in which said means for applying said correction value for further modification of the output signal of said air quantity measuring means is constituted for applying said correction value so as to minimize the difference between the said output signal of said air quantity measuring means as modified by said correction value and the most nearly corresponding one of said stored reference values.

76. Control system according to claim 36, in which said predetermined position of said throttle valve is a position in the high engine load region of the throttle valve position range and in which said means for applying said correction value for further modification of the output signal of said air quantity measuring means is constituted for applying said correction value so as to minimize the difference between the said output signal of said air quantity measuring means as modified by said correction value and the most nearly corresponding one of said stored reference values.

77. Control system according to claim 37, in which said predetermined position of said throttle valve is a position in the high engine load region of the throttle valve position range and in which said means for applying said correction value for further modification of the output signal of said air quantity measuring means is constituted for applying said correction value so as to minimize the difference between the said output signal of said air quantity measuring means as modified by said correction value and the most nearly correspondirg one of said stored reference values.

* * * * *